United States Patent [19]

Sinnecker

[11] 4,445,016

[45] Apr. 24, 1984

[54] VACUUM SWITCHING TUBE WITH METAL CAP

[75] Inventor: Günther Sinnecker, Berlin, Fed. Rep. of Germany

[73] Assignee: Siemens Aktiengesellschaft, Munich, Fed. Rep. of Germany

[21] Appl. No.: 352,532

[22] Filed: Feb. 26, 1982

[30] Foreign Application Priority Data

Feb. 26, 1981 [DE] Fed. Rep. of Germany ..... 3107821

[51] Int. Cl.[3] ..... H01H 33/66

[52] U.S. Cl. ..... 200/144 B; 174/50.57

[58] Field of Search ..... 200/144 B; 174/50.57, 174/50.58

[56] References Cited

U.S. PATENT DOCUMENTS

| | | | |
|---|---|---|---|
| 503,108 | 8/1893 | Bates | 174/50.57 |
| 523,204 | 7/1894 | Forest | 174/50.57 |
| 1,232,741 | 7/1917 | West | 174/50.57 |
| 2,826,630 | 3/1958 | Klebanoff et al. | 174/50.58 |
| 3,471,669 | 10/1969 | Curtis | 200/144 B |
| 4,150,270 | 4/1979 | Zunick | 200/144 B |

*Primary Examiner*—Robert S. Macon

*Attorney, Agent, or Firm*—Kenyon & Kenyon

[57] ABSTRACT

Disclosed is a vacuum switching tube comprising a hollow insulator and a cap closing off the insulator adjacent to its circumference at one end thereof. The cap is connected to the insulator by a joint. A shaped body covers the joint and is spaced therefrom. The space between the shaped body and the joint is filled with a bonding agent. Thereby, the joint is mechanically reinforced. The shaped body and the bonding agent substantially increase the break-off force between the cap and insulator when the vacuum switching tube is firmly clamped at one end during operation.

5 Claims, 2 Drawing Figures

VACUUM SWITCHING TUBE WITH METAL CAP

BACKGROUND OF THE INVENTION

The present invention relates to a vacuum switching tube having a fixed lead bolt and a movable lead bolt extending from a hollow cylindrical insulator, and a metal cap disposed at one or both ends of the tube concentrically to the respective lead bolt. The vacuum switching tube is advantageously used as part of an electric circuit breaker.

A vacuum switching tube of the above-described type is disclosed in DE-AS No. 1 245 472 and includes a shaped body disposed over a metal cap made of relatively thin material to reinforce the cap and reduce the possibility of leaks.

OBJECTS AND SUMMARY OF THE INVENTION

It is an object of the present invention to protect the joint between the cap and the hollow insulator in a vacuum switching tube of the above-described type.

It is another object of the present invention to reduce the danger of leaking by increasing the break force of the joint between the cap and the hollow insulator in a vacuum switching tube of the above-described type.

These and other objects are achieved, according to the invention, by disposing a shaped body and a bonding agent to cover the joint between the cap and the hollow insulator. The invention is particularly applicable to a vacuum switching tube having a hollow insulator made of a ceramic material to which a metal cap is connected by soldering. The solder joint is of a high quality vacuum type and is mechanically reinforced by the shaped body such that it not only withstands normal forces occurring during normal switching operations but also unpredictable shock and vibration stresses.

The invention thereby provides, in a vacuum switching tube which includes a hollow cylindrical insulator, a lead bolt extending through one end of the insulator, and a cap connected to the insulator by a joint at the end of the insulator adjacent to the circumference of the insulator, a shaped body disposed adjacent to the joint between the cap and the insulator and spaced therefrom, and a bonding agent interposed between the shaped body and the joint. Preferably, the shaped body extends substantially beyond the joint and as extended is adjacent to the insulator and the cap. In a disclosed embodiment, the shaped body has a cylindrical portion disposed adjacent to the cylindrical insulator and a conical portion disposed adjacent to the cap.

The shaped body may be made cap-like and may be oversized as indicated above to extend substantially beyond the joint to better receive the bonding agent. Many different materials may be used for the shaped body and the bonding agent, and the use of particular materials is not critical. For example, the shaped body can be metallic as well as non-metallic. Preferably, however, the materials are non-magnetic in order to avoid excessive heating during operation. For example, non-magnetic stainless steel is a suitable material for the shaped body. As for non-metallic materials, dimensionally stable plastics are preferred, particularly plastics which contain fiber-like fillers.

The shaped body can be secured to the insulator and cap by a epoxy resin as the bonding agent. For metal shaped bodies, the space between the shaped body and the insulator and cap can be filled with a metal liquid solder.

The above and other features, aspects and advantages of the present invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like reference indicate similar parts and in which.

DESCRIPTION OF THE PREFERRED EMBODIMENTS

Figure 1:
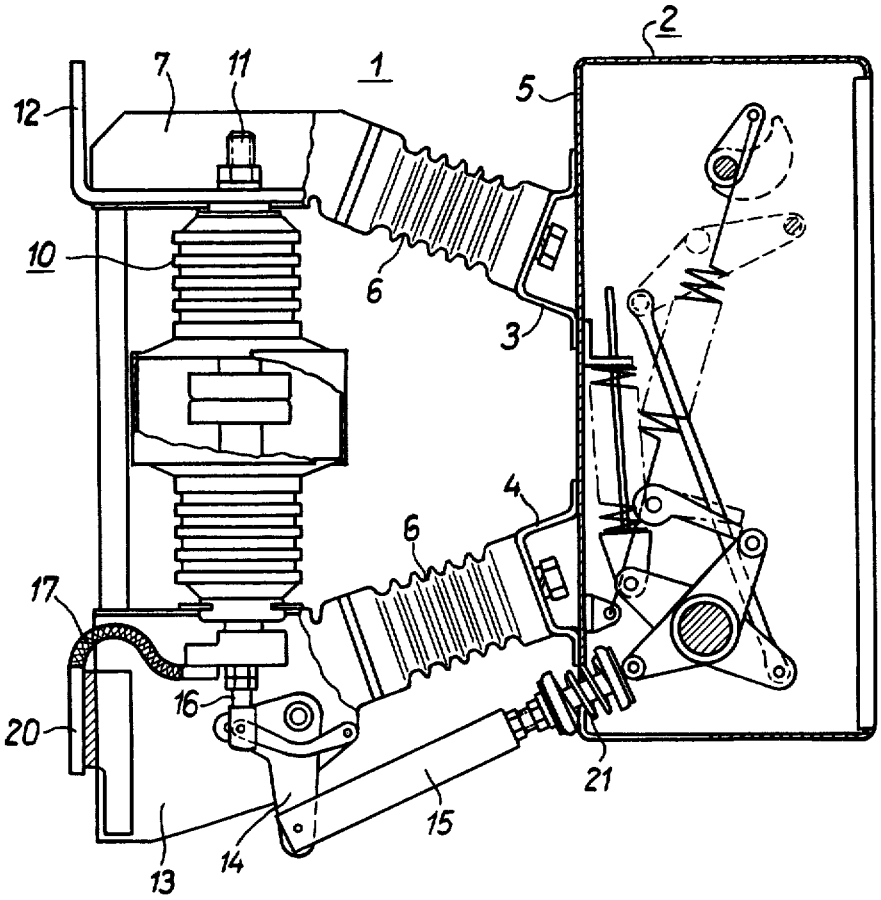
FIG. 1 is a side schematic view of a vacuum circuit breaker for medium operating voltages which includes a vacuum switching tube according to the invention.

Referring to FIG. 1, the vacuum circuit breaker 1 comprises an actuating mechanism contained in a housing 2. The housing 2 is of box-like shape having two bars 3 and 4 secured to an outside wall thereof. Support insulators 6 are fastened to the bars 3 and 4 extending at an angle to the wall supporting the bars 3 and 4. A head piece 7 is connected to the upper support insulator 6 and a vacuum switching tube 10 is fastened by a fixed lead bolt 11 to the head piece 7. This arrangement also connects the lead bolt to a contact bar 12.

The lower support insultor 6 supports an actuating base 13 which in turn supports a two-armed lever 14 connected between an insulating switching rod 15 and a movable lead bolt 16 of the switching tube 10. A flexible ribbon lead 17 electrically connects the lead bolt 16 and a lower contact bar 20. The insulating switching rod 15 is connected via a contact pressure spring 21 to an actuating mechanism contained in the housing 2, as shown only generally and not in detail in FIG. 1. The actuating mechanism can, for example, be a spring accumulator drive of the type described in DE-OS No. 2 717 958.

Figure 2:
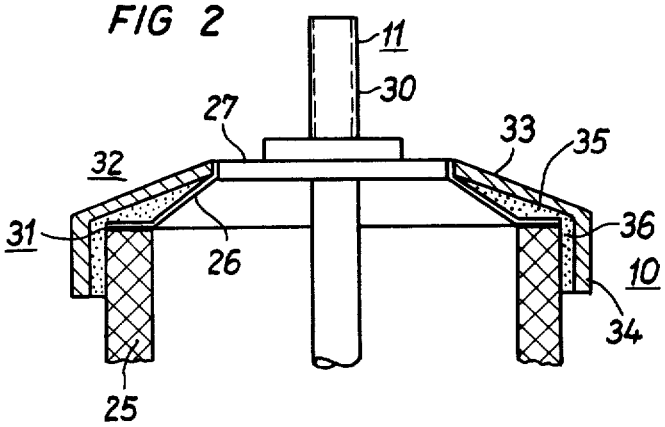
FIG. 2 is an enlarged side view of the upper portion of the vacuum switching tube of FIG. 1, partially in cross section.

Details of the vacuum switching tube 10 in the vicinity of its upper end which is connected to the head piece 7 are shown in FIG. 2. A metal cap 26 is soldered to the upper annular end of a hollow ceramic insulator 25 at the upper end of the vacuum switching tube 10. A further solder joint connects the metal cap 26 to a metal plate 27 which forms the upper termination of the vacuum switching tube 10 and accepts the lead bolt 11 having threaded portion 30.

The joint or seam 31 between the hollow insulator 25 and the metal cap 26 can be soldered so as to provide good vacuum tightness and good mechanical strength. Nevertheless, heavy mechanical stresses can weaken or damage the soldered seam 31, making the vacuum switching tube 10 leak and thereby rendering it unusable. According to the invention, the break-off force, i.e., the force necessary to separate the soldered seam 31 when the lead bolt 11 is firmly clamped at its end, is increased by a shaped body 32 provided as a cap which has an upper conical part 33 extending approximately from the upper end of the hollow insulator 25 to the closing plate 27 and an adjoining cylindrical surface 34 which is concentric with the hollow insulator 25. The inside dimensions of the shaped body 32 are configured to provide a space 35 which is filled with a bonding agent 36. A large-area bond between the shaped body 32 and the metal cap 26 as well as between the shaped body 32 and the adjoining region of the hollow insulator 25 is thereby obtained. In addition, the exterior of the soldered seam 31 is covered by the bonding agent 36.

As mentioned above, the shaped body 32 can be comprised of metallic as well as non-metallic materials. While different bonding agents can be used, adhesives or fillers of the epoxy resin type are preferred for fastening shaped bodies of metallic and non-metallic materials. In addition, shaped metal bodies can be fastened by metal solder disposed in the space between the shaped body and the hollow insulator as well as between the shaped body and the metal cap. Where solder is used, it is advisable to metallize the exterior surface of the hollow insulator adjoining the soldered seam 31 so that the solder makes a bond with the ceramic material.

The arrangement described herein of a shaped body and a bonding agent disposed in the vicinity of the soldered seam between the cap and the hollow insulator can be utilized not only at the end from which the fixed lead bolt 11 protrudes, but also at the opposite end from which the movable lead bolt 16 protrudes. However, it is not generally necessary to provide the arrangement at the end with lead bolt 16 and it is usually sufficient to provide the reinforcement at the end with bolt 11 as larger forces occur at that end in operation.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. In a vacuum switching tube, for an electrical circuit breaker, of the type comprising an insulating tubular body, a metal cap, a joint joining the metal cap at its periphery to one end of the tubular body and a current conducting bolt passing coaxially through the cap, the current conducting bolt being used in supporting the vacuum switching tube or in driving a movable contact of the vacuum switching tube, the improvement comprising a reinforcing body formed and positioned so as to extend around the periphery of said metal cap and cover said joint, said reinforcing body being fixed to the tubular body and the metal cap by a bonding agent disposed between the metal cap and the reinforcing body such that the joint between the metal cap and the tubular body is covered, and thereby reinforced, by said reinforcing body and said bonding agent.

2. The improvement according to claim 1 wherein the reinforcing body is in the form of a centrally apertured cap adapted to fit over said one end of the insulating body and over the metal cap with clearance to accommodate the bonding agent.

3. The improve according to claim 2 wherein the reinforcing body has a tubular portion disposed adjacent to the tubular body and a conical portion disposed over to the metal cap.

4. A method of manufacturing an evacuated switching tube, for an electrical circuit-breaker, of the type comprising an insulating tubular body, a metal cap, a joint joining the metal cap at its periphery to one end of the tubular body and a current conducting bolt passing coaxially through the cap, comprising the steps of forming and positioning a reinforcing body so that it extends around the periphery of said cap and covers said joint, and fixing the reinforcing body to the tubular body and the metal cap by a bonding agent so that the joint between the metal cap and the tubular body is covered, and thereby reinforced, by the reinforcing body and the bonding agent.

5. The method according to claim 4 wherein the reinforcing body is formed and positioned so that it fits over said one end of the tubular body and over the metal cap with clearance to accommodate the bonding agent.

* * * * *